US009316189B2

(12) United States Patent
Buckner et al.

(10) Patent No.: US 9,316,189 B2
(45) Date of Patent: Apr. 19, 2016

(54) FUEL INJECTION DEVICE FOR AN INTERNAL COMBUSTION ENGINE, AND ASSOCIATED METHOD

(75) Inventors: Gregory D. Buckner, Cary, NC (US); Tiegang Fang, Cary, NC (US)

(73) Assignee: North Carolina State University, Raleigh, NC (US)

( * ) Notice: Subject to any disclaimer, the term of this patent is extended or adjusted under 35 U.S.C. 154(b) by 941 days.

(21) Appl. No.: 12/812,553

(22) PCT Filed: Jan. 12, 2009

(86) PCT No.: PCT/US2009/030707

§ 371 (c)(1),
(2), (4) Date: Aug. 16, 2010

(87) PCT Pub. No.: WO2009/091685

PCT Pub. Date: Jul. 23, 2009

(65) Prior Publication Data

US 2011/0005499 A1 Jan. 13, 2011

Related U.S. Application Data

(60) Provisional application No. 61/020,774, filed on Jan. 14, 2008.

(51) Int. Cl.
*F02M 45/00* (2006.01)
*F02M 45/08* (2006.01)
(Continued)

(52) U.S. Cl.
CPC ..... *F02M 45/086* (2013.01); *F02M 61/06* (2013.01); *F02M 63/0064* (2013.01); *F02M 63/0066* (2013.01)

(58) Field of Classification Search
CPC . F02M 45/086; F02M 61/06; F02M 63/0064; F02M 63/0066
USPC ..... 239/533.12; 123/447, 467, 490, 496, 123/498, 305, 499; 251/129.01, 129.1, 251/129.15, 129.21
See application file for complete search history.

(56) References Cited

U.S. PATENT DOCUMENTS 2,951,647 A * 9/1960 Dreisin ..... 239/453
3,987,759 A * 10/1976 Roberts et al. ..... 123/206
(Continued)

FOREIGN PATENT DOCUMENTS

FR 2407361 A1 5/1979
GB 2281940 A 3/1995
JP 14-376547 A 7/2004

OTHER PUBLICATIONS

M. Morales Gonzalez, Patent Cooperation Treaty: International Search Report for Application No. PCT/EP2006/066000, Search Report, Apr. 6, 2009, pp. 1-4, International Searching Authority, European Patent Office, The Netherlands.
(Continued)

*Primary Examiner* — Erick Solis
*Assistant Examiner* — Carl Staubach
(74) *Attorney, Agent, or Firm* — Jenkins, Wilson, Taylor & Hunt, P.A.

(57) ABSTRACT

A fuel injection device and associated method are provided. An injector body defines an axial bore and has a nozzle exit extending into the combustion chamber. The injector body receives fuel within the bore and channels the fuel through the nozzle exit into the combustion chamber. A flow rate control member is movably disposed within the injector body bore and is actuatable by a first actuator to move with respect to and to interact with the nozzle exit to control a flow rate of the channeled fuel. A pintle member is movably disposed within a flow rate control member bore and is actuatable by a second actuator, independently of the flow rate control member, to move with respect to the flow rate control member and to interact with the nozzle exit to control a spray angle of the channeled fuel. The flow rate and spray angle are thereby independently controllable.

17 Claims, 9 Drawing Sheets

(51) Int. Cl.
*F02M 61/06* (2006.01)
*F02M 63/00* (2006.01)

(56) References Cited

U.S. PATENT DOCUMENTS

| | | | | |
|---|---|---|---|---|
| 4,077,374 | A * | 3/1978 | Willmann et al. | 123/536 |
| 4,205,790 | A | 6/1980 | Keiczek | |
| 4,230,273 | A * | 10/1980 | Claxton et al. | 239/125 |
| 4,235,375 | A * | 11/1980 | Melotti | 239/125 |
| 4,295,453 | A * | 10/1981 | Seilly et al. | 123/499 |
| 4,417,694 | A * | 11/1983 | Claxton et al. | 239/533.12 |
| 4,993,643 | A * | 2/1991 | Schechter et al. | 239/499 |
| 5,241,935 | A * | 9/1993 | Beck et al. | 123/300 |
| 5,467,754 | A * | 11/1995 | Beck et al. | 123/467 |
| 6,206,304 | B1 * | 3/2001 | Koseki et al. | 239/533.12 |
| 6,340,121 | B1 * | 1/2002 | Lambert | 239/533.4 |
| 6,705,274 | B2 * | 3/2004 | Kubo | 123/295 |
| 7,082,921 | B2 * | 8/2006 | Shimizu et al. | 123/305 |
| 7,140,562 | B2 * | 11/2006 | Holzgrefe et al. | 239/533.12 |
| 7,210,640 | B2 * | 5/2007 | Clarke et al. | 239/515 |
| 7,685,990 | B2 * | 3/2010 | Dingle | 123/299 |
| 7,766,254 | B2 * | 8/2010 | Trapasso | F02M 51/061 239/133 |
| 2005/0224605 | A1 * | 10/2005 | Dingle | 239/533.2 |
| 2006/0243242 | A1 * | 11/2006 | Blessing et al. | 123/299 |
| 2012/0138710 | A1 * | 6/2012 | Hicks | B05B 1/3013 239/455 |

OTHER PUBLICATIONS

M. Morales Gonzalez, Patent Cooperation Treaty: Written Opinion of the International Searching Authority for Application No. PCT/US2009/030707, Written Opinion, Apr. 6, 2009, pp. 1-6, International Searching Authority, European Patent Office, The Netherlands.

Ellen Moyse, M. Morales Gonzalez, PCT International Preliminary Report on Patentability and Written Opinion of the International Searching Authority for PCT Application No. PCT/US2009/030707, Jul. 20, 2010, pp. 1-7, The International Bureau of WIPO, Geneva, Switzerland.

* cited by examiner 110
102

FUEL INJECTION DEVICE FOR AN INTERNAL COMBUSTION ENGINE, AND ASSOCIATED METHOD

This application is a National Stage application of, claims priority to, and claims the benefit of International Application No. PCT/US2009/030707, titled "FUEL INJECTION DEVICE FOR AN INTERNAL COMBUSTION ENGINE, AND ASSOCIATED METHOD," filed Jan. 12, 2009, in the United States Patent and Trademark Office Patent Cooperation Treaty Receiving Office, which further claims priority to, and claims the benefit of U.S. Provisional Patent Application No. 61/020,774, titled "FUEL INJECTION DEVICE FOR AN INTERNAL COMBUSTION ENGINE, AND ASSOCIATED METHOD," filed Jan. 14, 2008, in the United States Patent and Trademark Office, the entire contents of each application are hereby incorporated by reference as if fully set forth herein.

BACKGROUND OF THE INVENTION

1. Field of the Invention

Embodiments of the present invention relate to internal combustion engines and, more particularly, to a fuel injection device for an internal combustion engine, and a method associated therewith.

2. Description of Related Art

In general, an internal combustion engine is an engine wherein combustion of fuel and an oxidizer (typically air) occurs in a confined space, such as a combustion chamber, to convert thermal energy into mechanical energy. Typically, these engines use a spark ignition method or compression ignition system to create combustion. The spark ignition method generally involves delivering fuel to the combustion chamber via a fuel injector wherein an air-fuel mixture is ignited by a spark from a spark plug, as known by those of ordinary skill in the art. In compression ignition systems, as typically used with diesel fuel and engines, the combustion is triggered by sufficiently high compression of fuel and air within the combustion chamber. However, incomplete combustion of carbonaceous fuel within such systems due to inherent inefficiencies may produce high pollution levels.

As such, Homogeneous Charge Compression Ignition (HCCI) combustion or low-temperature combustion modes are gaining traction, since such systems may provide ultra-low particulates and oxides of nitrogen emissions from internal combustion engines that may help to meet increasingly restrictive emission standards. However, precise and accurate control of the air-fuel mixing process in the engine cylinder, with improved injection strategies under wide operating speed and load regimes, is lacking in HCCI combustion technologies. Current fuel injection devices may not meet HCCI combustion requirements. HCCI combustion has the potential to reduce $NO_x$ and soot emissions from diesel engines and to reduce $NO_x$, HC, and CO emissions from gasoline engines, while simultaneously increasing thermal efficiencies. However, HCCI technology faces critical design challenges to obtain homogenous air-fuel fixtures, to control ignition timing, and to expand to high load conditions. This may be particularly true for diesel engines, as the higher boiling point of diesel fuels makes mixture preparation even more challenging than the gasoline fuels.

Further, current fuel delivery techniques may lack flexibility in meeting the mixture requirements for HCCI due to fixed injection angles of the fuel by the fuel injection devices. Fuel-wall impingement and cylinder-liner wetting may occur for some current injection devices, which undesirably result in higher Hydrocarbon (HC) and carbon monoxide (CO) emissions and lower fuel efficiency. For example, in fuel injectors with large fixed injection angles, when the injection timing is very early in the compression stroke, severe wall wetting occurs with a significant amount of fuel impingement on the cylinder liner. However, for the conventional injection timing, liquid distribution is optimized in the piston bowl at large fixed injection angles. A narrow angle injector, on the other hand, provides very good fuel distribution for early injection timing, but not for conventional injection timing. As such, a single injection angle cannot adequately meet the air-fuel mixing requirements for injection strategies with very early or late injection timings.

Accordingly, there is needed an improved fuel injection device for providing improved operation of internal combustion engines employing direct injection technology.

BRIEF SUMMARY OF THE INVENTION

The above and other needs are met by the present invention which, in one aspect, provides a fuel injection device adapted to channel fuel into a combustion chamber of an internal combustion engine. Such a fuel injection device comprises an injector body defining a bore extending axially therethrough and having a nozzle exit adapted to extend into the combustion chamber, wherein the injector body is further adapted to receive the fuel within the bore and to channel the fuel through the nozzle exit. A flow rate control member is disposed within the injector body bore and is movable with respect thereto. The flow rate control member is actuatable by a first actuator to move with respect to and to interact with the nozzle exit to control a flow rate of the fuel channeled into the combustion chamber. A pintle member is disposed within an axial bore defined by the flow rate control member and is movable with respect thereto. The pintle member is actuatable by a second actuator, independently of the flow rate control member, to move with respect to the flow rate control member and to interact with the nozzle exit to control a spray angle of the fuel channeled into the combustion chamber. The flow rate and spray angle of the fuel channeled into the combustion chamber are thereby independently controllable.

Another aspect of the present invention comprises a method of channeling fuel into a combustion chamber of an internal combustion engine. Such a method comprises receiving the fuel within a bore defined by an injector body and extending axially therethrough to a nozzle exit and channeling the fuel through the nozzle exit into the combustion chamber. A flow rate control member disposed within the injector body bore is actuated with a first actuator so as to move the flow rate control member with respect to the nozzle exit such that the flow rate control member interacts with the nozzle exit to control a flow rate of the fuel channeled into the combustion chamber. A pintle member disposed within an axial bore defined by the flow rate control member bore is actuated with a second actuator, independently of the flow rate control member, so as to move the pintle member with respect to the flow rate control member such that the pintle member interacts with the nozzle exit to control a spray angle of the fuel channeled into the combustion chamber. The flow rate and spray angle of the fuel channeled into the combustion chamber are thereby independently controllable.

Yet another aspect of the present invention comprises a fuel injection device adapted to channel fuel into a combustion chamber of an internal combustion engine. Such a fuel injection device comprises an injector body defining a bore extending axially therethrough and having a nozzle exit adapted to extend into the combustion chamber. The injector body is further adapted to receive the fuel within the bore and to channel the fuel through the nozzle exit. A flow rate control member is disposed within the injector body bore and is movable with respect thereto. A first actuator is configured to actuate the flow rate control member to move with respect to and to interact with the nozzle exit to control a flow rate of the fuel channeled into the combustion chamber, wherein the flow rate control member further defines an axial bore. A pintle member is disposed within the flow rate control member bore and is movable with respect thereto. A second actuator is configured to actuate the pintle member, independently of the flow rate control member, to move with respect to the flow rate control member and to interact with the nozzle exit to control a spray angle of the fuel channeled into the combustion chamber, whereby the flow rate and spray angle of the fuel channeled into the combustion chamber are independently controllable.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 8A:
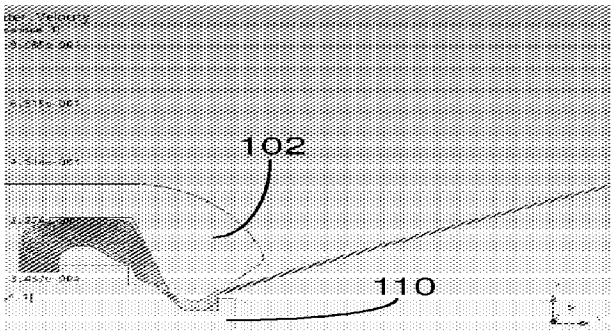
FIGS. 8A and 8B are schematic cross-sectional views of a fuel injection device according to one embodiment of the present invention, illustrating the path of the fuel exiting the fuel injection device at various positions of a pintle member.
Figure 8B:
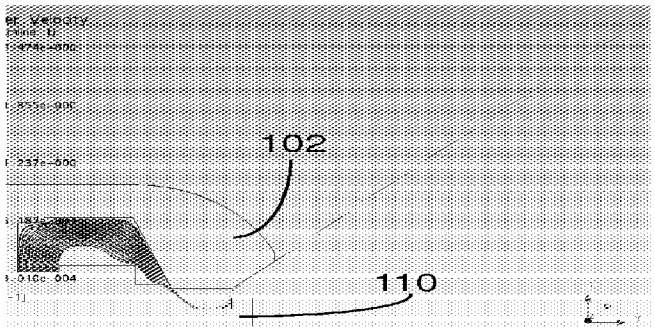
Figure 9A:
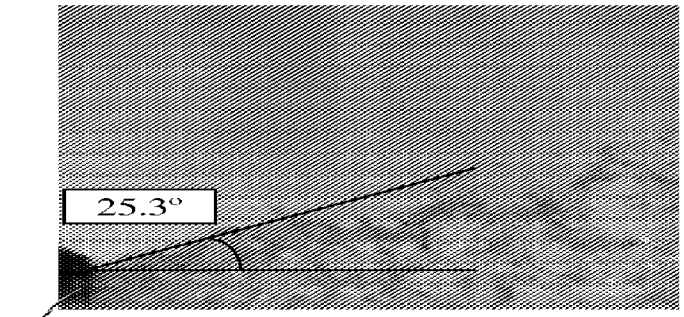
Figure 9B:
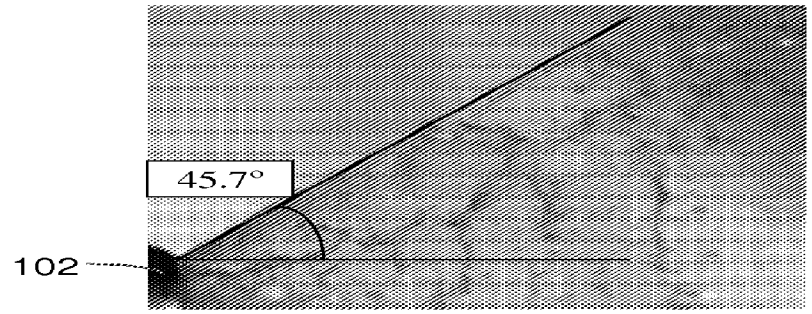
Figures 10A, 10B, 10C, 10D, 10E, 10F, 10G, 10H, 10I:
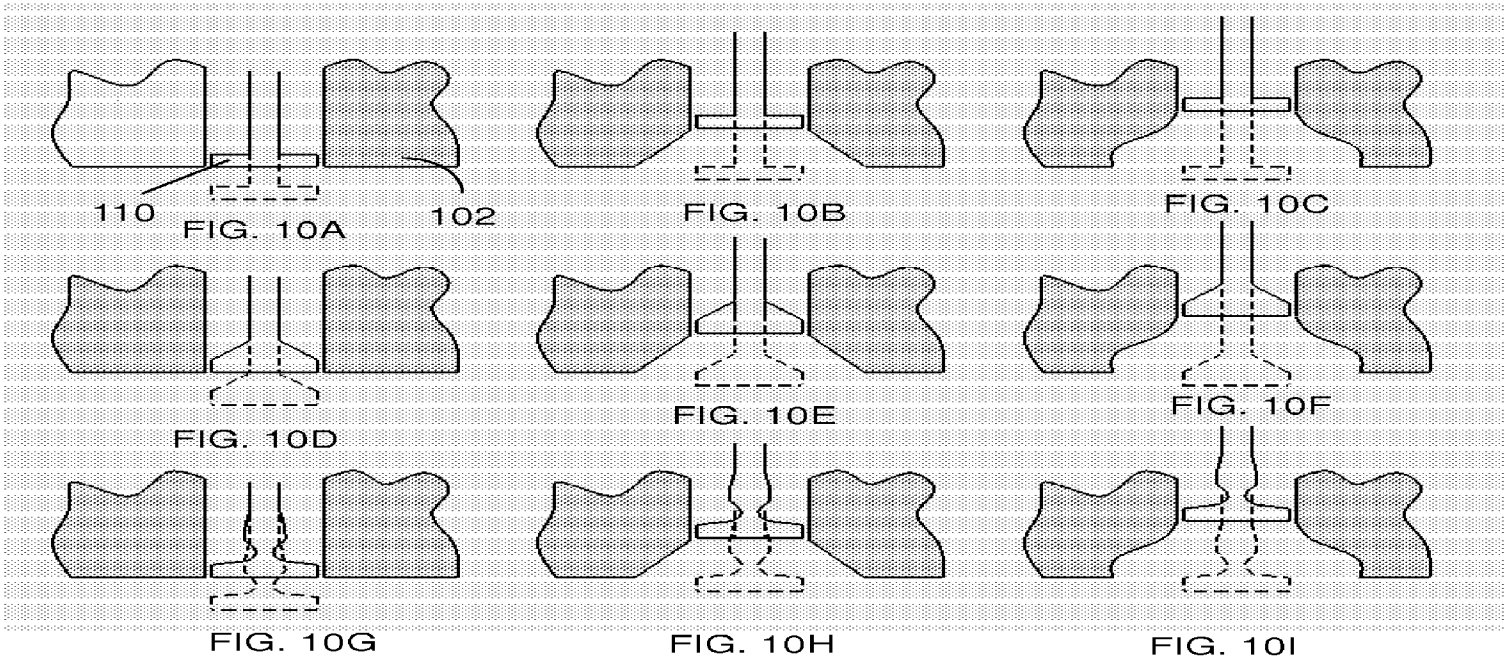

FIGS. 9A and 9B are partial cross-sectional views of a fuel injection device according to one embodiment of the present invention, illustrating the path of the fuel exiting the fuel injection device at various positions of a pintle member, as corresponding to FIGS. 8A and 8B, respectively; and FIGS. 10A-10I are schematic cross-sectional views of various configurations for a pintle member and nozzle exit for a fuel injection device according to various aspects of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1, 2, 3, 4A, 4B, 5A, 5B, and 6A-6C schematically illustrate a fuel injection device according to one embodiment of the present invention, the fuel injection device being generally indicated by the numeral 100. The fuel injection device 100 is configured to independently change the spray geometry (or spray angle) and flow rate of fuel injected into a combustion chamber of an internal combustion engine to provide, for example, low emission combustion. The fuel injection device 100 is configured to improve the flexibility in spray geometry and the control of the flow rate of fuel injected into the combustion chamber of an internal combustion engine. Accuracy and control of the air-fuel mixing process for HCCI combustion may thus be improved. The fuel injection device 100 may also be adapted to both Spark-Ignition (SI) and Compression Ignition (CI) engines. The fuel injection device 100 is configured to adaptively control fuel injection angles and fuel flow rates into the combustion chamber. In some embodiments, a resulting "hollow cone" spray pattern will thus continually adapt or change based on piston position, resulting in improved combustion efficiency with lower emissions. The fuel injection device 100 may be used for any fluid delivery process requiring independent control of fuel flow rate and fuel spray geometry.

The fuel injection device 100 may include two actuators, one to control fuel flow rate and a second to control fuel spray angle. In such instances, the two actuators can regulate the fuel spray geometry and fuel flow rate independently and continuously throughout the injection process. The fuel injection device 100 is configured such that the cone angle and flow rate may be controlled independently. As such, the cone spray pattern of the fuel may be continuously adjusted according to piston position to provide improved combustion efficiency and reduced particulate emissions. The fuel injection device 100 may be readily transferred to almost any internal combustion engine requiring liquid fuel injection: gasoline or diesel, mobile or stationary, military or civilian. Such a fuel injection device 100 may speed the commercialization of HCCI engines, which promise higher thermal efficiencies and near-zero pollution emissions. Although, it is envisioned that such a fuel injection device may be used in SI and CI engines, also, or any other system requiring a fluid delivery process.

Figure 1:
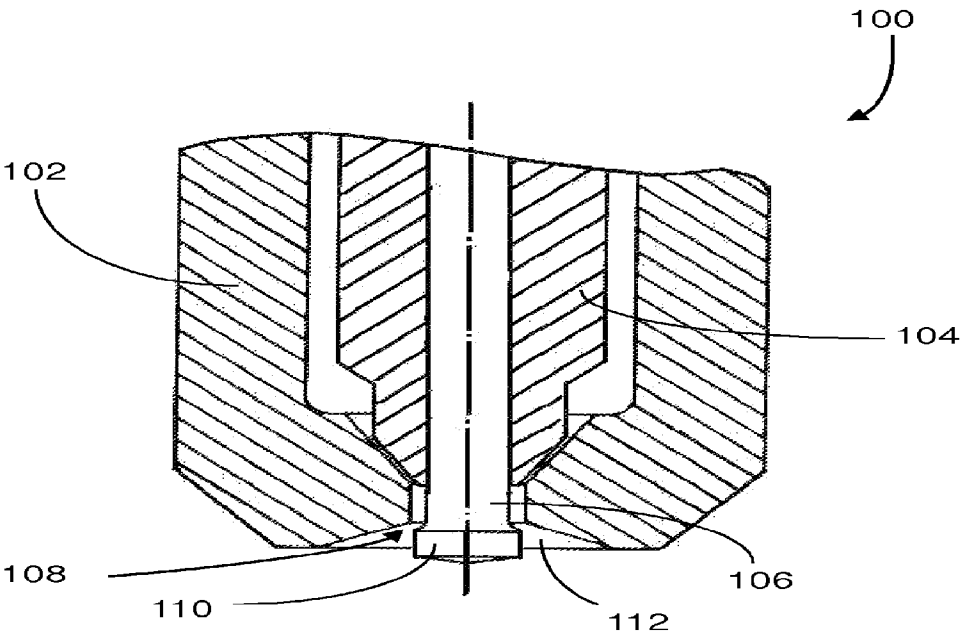
FIG. 1 is a schematic cross-sectional elevation of a fuel injection device according to one embodiment of the present invention.
Figure 2:
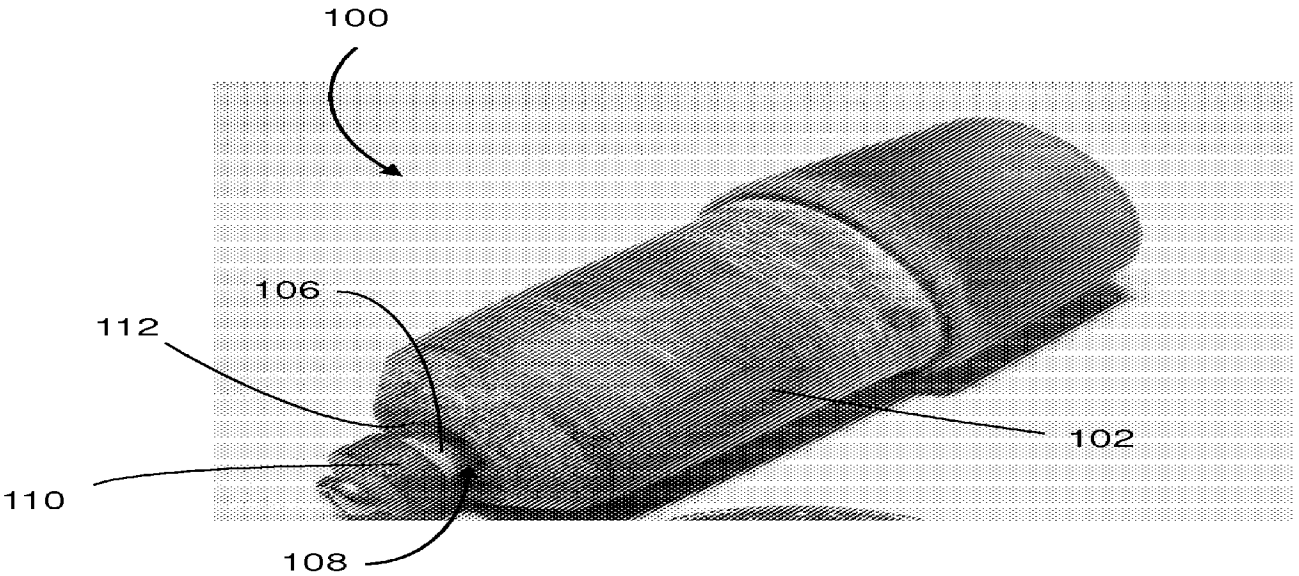
FIG. 2 is a perspective view of a fuel injection device according to one embodiment of the present invention as implemented in a fuel injection system for an internal combustion engine.
Figure 3:
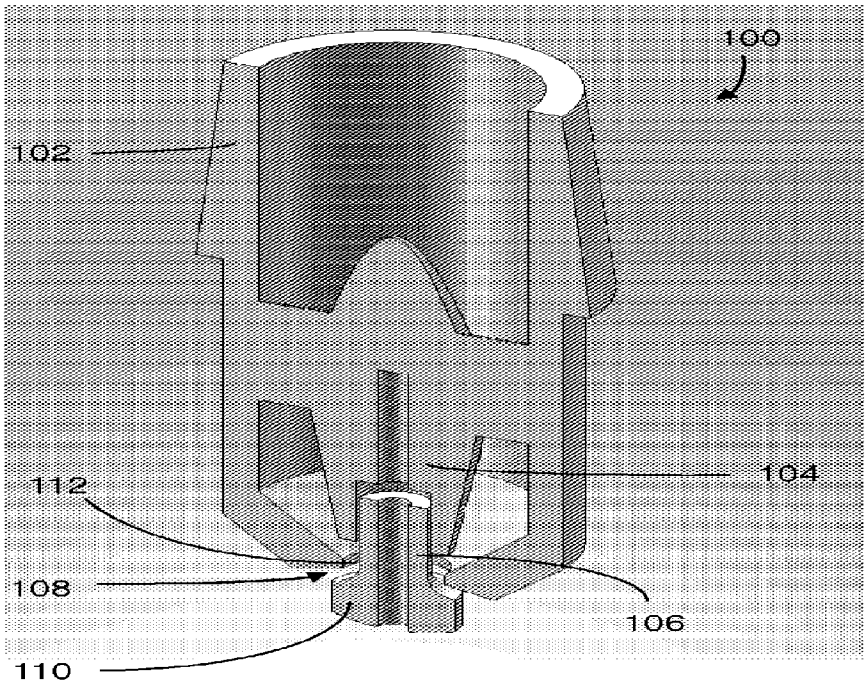
FIG. 3 is a schematic cross-sectional perspective view of a fuel injection device according to one embodiment of the present invention.
Figure 4A:
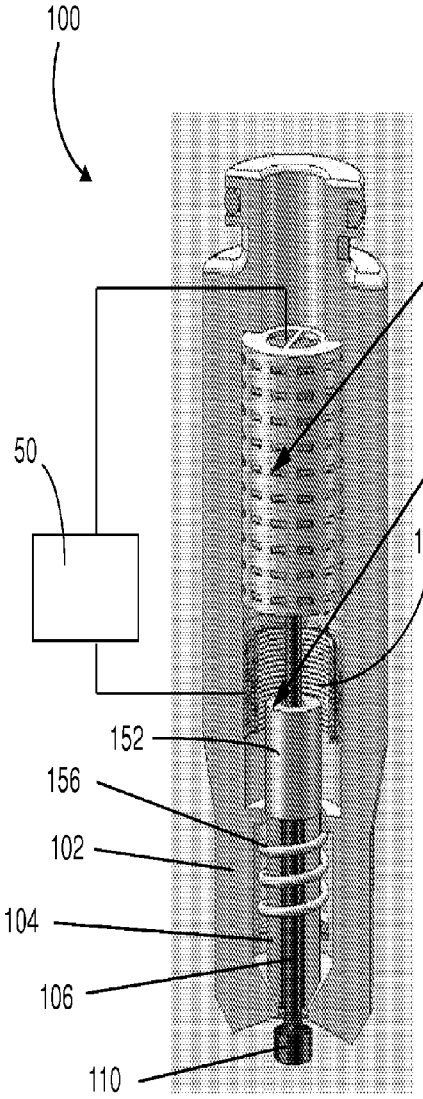
FIG. 4A is a schematic cross-sectional perspective view of a fuel injection device having first and second actuators, according to one embodiment of the present invention.
Figure 4B:
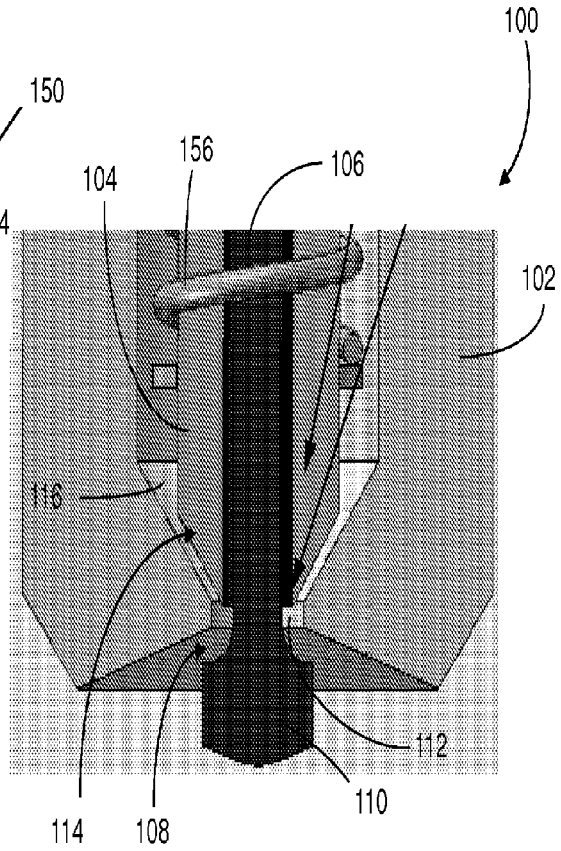
FIG. 4B is a partial schematic cross-sectional view of a fuel injection device according to one embodiment of the present invention.

Typically, fuel is generally delivered into the engine cylinder of an internal combustion engine via a multi-hole injection device with fixed injection cone angles for both SI and CI engines. Advantageously, using the fuel injection device 100, the spray cone angle of the fuel and fuel flow rate may be independently controlled by varying the injection pulse width and changing the pintle member location in the injection nozzle, wherein adjusting the location of the pintle member adjusts the spray cone angle. In one embodiment, as illustrated in FIGS. 5A, 5B, and 6A-6C, such a fuel injection device 100 may comprise an injector body 102 operably disposed between a fuel line 200 and a combustion chamber 300 of an internal combustion engine as defined, for example, by a piston cylinder 350. As shown in FIGS. 1, 3, 4A and 4B, the fuel injection device 100 further includes a flow rate control member 104 (e.g., a valve) disposed within an axial bore defined by the injector body 102. The flow rate control member 104 may be moved within the injector body bore with respect to a nozzle exit 112 by a first actuator 150 (FIG. 4A). The flow rate control member 104 is thus configured to interact with the nozzle exit 112 (i.e., as "opened" and "closed" by the first actuator 150) to control the fuel flow rate into the combustion chamber 300. For example, the first actuator 150 may comprise an electromechanical actuation system for moving the flow rate control member 104 within the injector body bore. In other instances, the first actuator 150 for the flow rate control member 104 may comprise a solenoid controlled via a micro-controller. In some instances, the first actuator 150 may comprise, for example, a movable body member 152, a magnetic coil member 154, and a resilient member 156 configured to interact with the flow rate control member. In any instance, a controller 50 may be in communication with the first actuator 150 for controlling actuation thereof. In some aspects, an end portion 114 of the flow rate control member 104 may be substantially frusto-conically shaped, wherein an inner surface 116 at or proximal to the nozzle exit 112 of the injector body 102 may be correspondingly shaped such that the flow rate control member 104 is capable of interacting therewith to control the fuel flow rate into the combustion chamber 300. However, the terminal portion 110 of the pintle member 106 may include and implement various other geometries and/or configurations such as, for example, those configurations illustrated in FIGS. 10A-10I. Of course, one of skill in the art will recognize that many other geometries and/or configurations may be implemented. Further, the nozzle exit 112 may also have various geometries and/or configurations for varying the interaction between the terminal portion 110 and the nozzle exit 112, as also shown in FIGS. 10A-10I.

The fuel injection device 100 further includes an adjustable pintle member 106 movably disposed within an axial bore defined by the flow rate control member 104. The pintle member 106 may be moved within the flow rate control member bore by a second actuator 160 (FIG. 4A), independently of the flow rate control member 104 and the first actuator 150 controlling the flow rate control member 104. As such, the pintle member 106 may be configured to move independently of the flow rate control member 104 and axially with respect to the injector body 102 so as to interact with the nozzle exit 112. The interaction between a terminal portion 110 of the pintle member 106 and the nozzle exit 112 thus adjusts the spray angle (or spray geometry) of the fuel being injected into the combustion chamber 300. More particularly, in some aspects, a gap 108 defined between the terminal portion 110 of the pintle member 106 and the nozzle exit 112 determines the injection cone angle/spray angle/spray geometry.

According to some aspects, the pintle member 106 may be adjusted/moved by a second actuator 160 comprising, for example, an electromechanical or piezo-electric actuator. The second actuator 160/actuation system for the pintle member 106 may be linearly configured and comprise, for instance, a piezoelectric linear actuator controlled by a micro-controller. In some instances, the controller 50 may be configured to control actuation of the second actuator 160, in addition to controlling actuation of the first actuator 150, wherein the controller 50 may be in communication with or otherwise comprise a portion of the overall electrical/wiring scheme of the apparatus/assembly having an internal combustion engine implementing the fuel injection device 100. In this regard, the first actuator 150 and the second actuator 160 may be independently controlled by the controller 50 such that the spray angle can be continuously varied throughout the injection process, independently of the fuel flow rate. In other instances, the first actuator 150 and the second actuator 160 may have separate/independent controllers (e.g., micro-controllers) for controlling actuation of the respective first and second actuator 150, 160. That is, in some instances, the first actuator 150 may be controlled by a first controller (not shown) and the second actuator 160 may be controlled by a second controller (not shown).

Figures 7A, 7B:
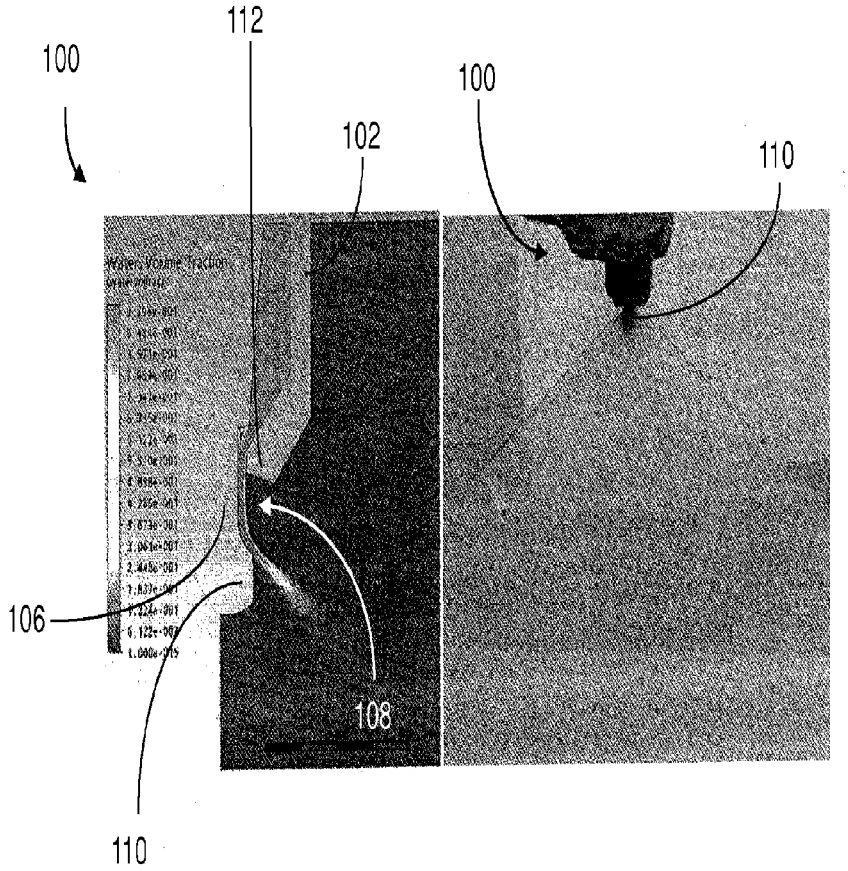
FIG. 7A is a partial cross-sectional view of a fuel injection device according to one embodiment of the present invention, illustrating the path of the fuel exiting the fuel injection device.
FIG. 7B is a side elevation of a hollow cone spray being dispersed from a fuel injection device according to one embodiment of the present invention.

Advantageously, the fuel injection device 100 comprises a valve-independent pintle mechanism, which flexibly varies the gap between the terminal portion 110 of the pintle 106 and the nozzle exit 112 and thus changes the spray cone angle. As generally illustrated in FIGS. 7A and 7B, the flow of the fuel may be determined by the shape of the pintle member 106, particularly for large pintle displacements. Due to the high fuel pressures used in direct injection systems, the range of travel for the pintle member 106 may be relatively small (e.g., less than 100 μm). As such, piezoelectric actuation may be particularly employed by the second actuator 160 to enable high-bandwidth control of motion at this relatively small scale.

Figure 5A:
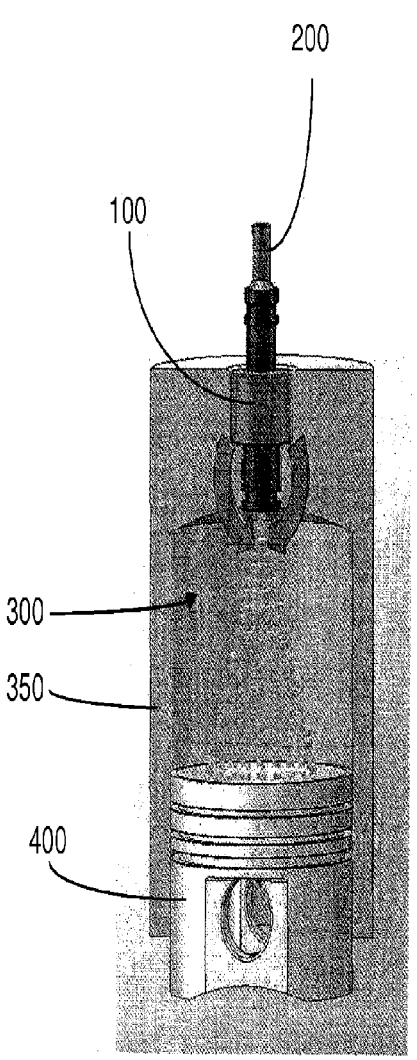
FIGS. 5A and 5B are schematic perspective views of a fuel injection device according to one embodiment of the present invention as implemented in a fuel injection system for an internal combustion engine.
Figure 5B:
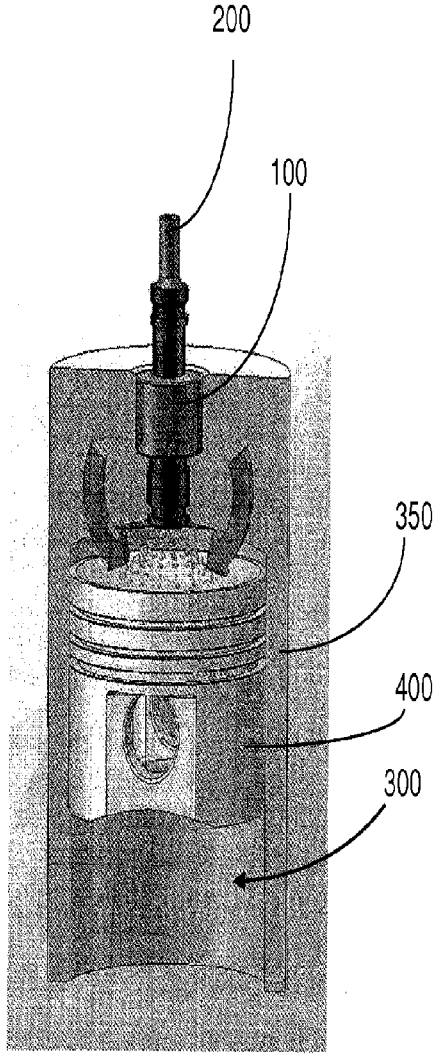
Figures 6A, 6B, 6C:
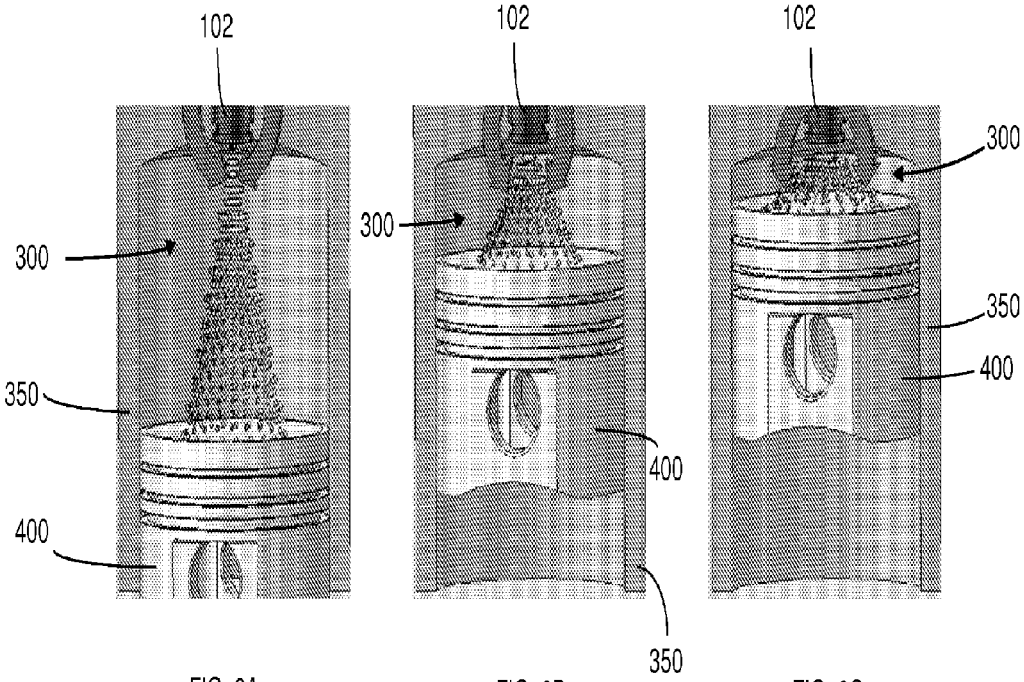
FIGS. 6A-6C are partial schematic perspective views of a fuel injection device according to one embodiment of the present invention as implemented in a fuel injection system for an internal combustion engine.

As shown in FIGS. 5A, 5B, and 6A-6C, in order to optimize the mixing, injection and combustion of fuel, the fuel injection device 100 can continuously vary the fuel spray angle as it enters the combustion chamber 300. Such variance may ensure that the maximum amount of fuel is burned at peak efficiency, optimizing power output and fuel economy. The fuel injection device 100 is thus configured to continually adapt the spray angle to maintain optimal combustion. As shown in FIGS. 5A and 6A, the fuel injection device 100 may be adapted to provide a narrow spray cone angle for early-stage injection. As shown in FIGS. 5B and 6C, the fuel injection device 100 may be adapted to provide a wide cone angle for injection near top dead center conditions. As shown in FIG. 6B, the fuel injection device 100 may be adapted to provide an intermediate spray cone angle between the narrow spray cone angle for early-stage injection and the wide cone angle for injection near top dead center conditions. Narrow angle injection avoids liner wetting by keeping the fuel primarily in the central region of the cylinder. However, when applied at high loads, large amounts of fuel may be deposited on the piston wall. Accordingly, adjusting the spray angle with respect to the position of the piston 400 greatly reduces wall wetting. As such, the fuel injection device 100 adaptively controls injection angles and fuel flow rates independently of each other to provide, in some embodiments, a "hollow cone" spray pattern which continually adapts in configuration based on the position of piston 400, resulting in optimal combustion efficiency with minimal emissions. In some instances, the fuel injection device 100 may be configured to provide a hollow-cone fuel spray with included angles between about 70° and 150°. As shown in FIGS. 8A and 9A, the terminal portion 110 of the pintle member 106 may be positioned so as to provide a relatively narrow spray cone angle (e.g., about 25.3° with respect to the longitudinal axis of the pintle member 106). As shown in FIGS. 8B and 9B, the terminal portion 110 of the pintle member 106 is illustrated as further displaced from the nozzle exit than as shown in FIGS. 8A and 8B. In this regard, the pintle member 106 is positioned so as to provide a relatively wide spray cone angle (e.g., about 45.7° with respect to the longitudinal axis of the pintle member 106). That is, the spray cone angle increases (i.e., becomes wider) as the terminal portion 110 of the pintle member 106 is increasingly displaced from the nozzle exit 112.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For example, the disclosed injection device may be implemented in a variety of applications other than internal combustion engines. For instance, the injection device may be implemented in liquid fuel applications (e.g., gas turbines, rocket engines, boiler burners, etc.), washing and cleaning, liquid metal atomization, spray coating deposition, spray cooling, agricultural and forest spraying, and liquid dispensing. Of course, one of skill in the art will recognize various other applications not provided herein for which the disclosed apparatus may be implemented in light of this disclosure. Although specific terms are employed herein, they are used in a generic and descriptive sense only and not for purposes of limitation.

That which is claimed:

1. A fuel injection device that channels fuel into a combustion chamber of an internal combustion engine, comprising:

a first actuator comprising a resilient member;

a second actuator;

an injector body defining an injector body axial bore extending axially therethrough and comprising a nozzle exit that extends into the combustion chamber, where the injector body receives the fuel within the injector body axial bore and channels the fuel through the nozzle exit;

a flow rate control member controlled via the first actuator and disposed within the injector body axial bore that controls, in response to actuation of the first actuator by a controller, a flow rate of the fuel channeled into the combustion chamber by moving axially with respect to the injector body axial bore and interacting with the nozzle exit, the flow rate control member further defining a flow rate control member axial bore, wherein the resilient member is disposed adjacent to an outer surface of the flow rate control member; and a pintle member controlled via the second actuator and disposed within the flow rate control member axial bore that controls, in response to actuation of the second actuator by the controller, a spray angle of the fuel channeled into the combustion chamber without substantially altering the flow rate of the fuel by moving axially with respect to the flow rate control member axial bore independently of the flow rate control member and interacting with the nozzle exit, wherein the pintle member comprises a longitudinally extending body that is hollow throughout an entirety of its length, a curved transition region having a first end adjacent to a first end of the longitudinally extending body, and a terminal portion disposed adjacent to a second end of the curved transition region and comprising a cylindrical portion having a constant diameter that is at least partially disposed external to the nozzle exit of the injector body axial bore;

wherein the flow rate and the spray angle of the fuel channeled into the combustion chamber are independently controlled;

wherein the second actuator is configured to continually adapt the spray angle, which comprises a hollow cone spray pattern, based on a position of a piston within the combustion chamber; and wherein the terminal portion of the pintle member is adjustably displaceable from the nozzle exit in order to provide at least a narrow, hollow spray cone angle, an intermediate, hollow spray cone angle, and a wide, hollow spray cone angle, a spray axis of each hollow cone spray angle being coincident to a longitudinal central axis of the pintle member.

2. The fuel injection device according to claim 1, further comprising the controller.

3. The fuel injection device according to claim 1, where the first actuator comprises a solenoid.

4. The fuel injection device according to claim 1, where the first actuator comprises an electromechanical system.

5. The fuel injection device according to claim 1, where the second actuator comprises one of an electromechanical actuator and a piezoelectric actuator.

6. The fuel injection device according to claim 1, where the actuation of the second actuator by the controller causes the pintle member to control the spray angle of the fuel channeled into the combustion chamber via a range of axial displacement of the terminal portion of the pintle member from the nozzle exit between zero (0) and one hundred (100) micrometers (μm).

7. A method of channeling fuel into a combustion chamber of an internal combustion engine, comprising:

receiving the fuel within an injector body axial bore defined by an injector body that extends axially therethrough to a nozzle exit that extends into the combustion chamber;

channeling the fuel through the nozzle exit into the combustion chamber;

controlling, via a controller by actuation of a first actuator comprising a resilient member that axially moves a flow rate control member disposed within the injector body axial bore, a flow rate of the fuel channeled into the combustion chamber by moving the flow rate control member axially with respect to the nozzle exit and causing the flow rate control member to interact with the nozzle exit, wherein the resilient member is disposed adjacent to an outer surface of the flow rate control member; and controlling, via the controller by actuation of a second actuator that axially moves a pintle member disposed within a flow rate control member axial bore defined by the flow rate control member, a spray angle of the fuel channeled into the combustion chamber without substantially altering the flow rate of the fuel by moving the pintle member axially with respect to the flow rate control member axial bore independently of the flow rate control member and causing the pintle member to interact with the nozzle exit, wherein the pintle member comprises a longitudinally extending body that is hollow throughout an entirety of its length, a curved transition region having a first end adjacent to a first end of the longitudinally extending body, and a terminal portion disposed adjacent to a second end of the curved transition region and comprising a cylindrical portion having a constant diameter that is at least partially disposed external to the nozzle exit of the injector body axial bore;

wherein the flow rate and the spray angle of the fuel channeled into the combustion chamber are independently controlled;

wherein the second actuator is configured to continually adapt the spray angle, which comprises a hollow cone spray pattern, based on a position of a piston within the combustion chamber; and wherein the terminal portion of the pintle member is adjustably displaceable from the nozzle exit in order to provide at least a narrow, hollow spray cone angle, an intermediate, hollow spray cone angle, and a wide, hollow spray cone angle, a spray axis of each hollow cone spray angle being coincident to a longitudinal central axis of the pintle member.

8. The method according to claim 7, where the first actuator comprises a solenoid.

9. The method according to claim 7, where the first actuator comprises an electromechanical system.

10. The method according to claim 7, where the second actuator comprises one of an electromechanical actuator and a piezoelectric actuator.

11. The method according to claim 7, where controlling, via the controller by actuation of the second actuator that axially moves the pintle member disposed within the flow rate control member axial bore defined by the flow rate control member, the spray angle of the fuel channeled into the combustion chamber comprises adjusting, via the controller, the actuation of the second actuator and causing the pintle member to move axially via a range of axial displacement of the terminal portion of the pintle member from the nozzle exit between zero (0) and one hundred (100) micrometers (μm).

12. A fuel injection device adapted to channel fuel into a combustion chamber of an internal combustion engine, comprising:

an injector body defining an injector body axial bore extending axially therethrough and comprising a nozzle exit that extends into the combustion chamber, where the injector body receives the fuel within the injector body axial bore and channels the fuel through the nozzle exit;

a flow rate control member disposed within the injector body axial bore and that moves axially with respect thereto;

a first actuator comprising a resilient member, controlled via a controller, that controls a flow rate of the fuel channeled into the combustion chamber by causing the flow rate control member to move axially with respect to the injector body axial bore and to interact with the nozzle exit, the flow rate control member further defining a flow rate control member axial bore, wherein the resilient member is disposed adjacent to an outer surface of the flow rate control member;

a pintle member disposed within the flow rate control member axial bore and that moves axially with respect thereto, wherein the pintle member comprises a longitudinally extending body that is hollow throughout an entirety of its length, a curved transition region having a first end adjacent to a first end of the longitudinally extending body, and a terminal portion disposed adjacent to a second end of the curved transition region and comprising a cylindrical portion having a constant diameter that is at least partially disposed external to the nozzle exit of the injector body axial bore; and a second actuator, controlled via the controller, that controls a spray angle of the fuel channeled into the combustion chamber without substantially altering the flow rate of the fuel by causing the pintle member to move axially with respect to the flow rate control member axial bore independently of the flow rate control member and to interact with the nozzle exit;

wherein the flow rate and the spray angle of the fuel channeled into the combustion chamber are independently controlled;

wherein the second actuator is configured to continually adapt the spray angle, which comprises a hollow cone spray pattern, based on a position of a piston within the combustion chamber; and wherein the terminal portion of the pintle member is adjustably displaceable from the nozzle exit in order to provide at least a narrow, hollow spray cone angle, an intermediate, hollow spray cone angle, and a wide, hollow spray cone angle, a spray axis of each hollow cone spray angle being coincident to a longitudinal central axis of the pintle member.

13. The fuel injection device according to claim 12, further comprising the controller.

14. The fuel injection device according to claim 12, where the first actuator comprises a solenoid.

15. The fuel injection device according to claim 12, where the first actuator comprises an electromechanical system.

16. The fuel injection device according to claim 12, where the second actuator comprises one of an electromechanical actuator and a piezoelectric actuator.

17. The fuel injection device according to claim 12, where actuation of the second actuator by the controller controls the spray angle of the fuel channeled into the combustion chamber via a range of axial displacement of the terminal portion of the pintle member from the nozzle exit between zero (0) and one hundred (100) micrometers (μm).

* * * * *